United States Patent [19]

Holoubek et al.

[11] Patent Number: 4,666,063

[45] Date of Patent: May 19, 1987

[54] CONTAINER WITH TWIST-OFF TAMPER EVIDENT FEATURE

[75] Inventors: George H. Holoubek, Muscatine; Eugene M. Anthony, Bloomington Township, McLean County; Allan B. Hans, Fruitland Township, McLean County, all of Iowa

[73] Assignee: Wheeling Stamping Company, Wheeling, W. Va.

[21] Appl. No.: 768,847

[22] Filed: Aug. 23, 1985

[51] Int. Cl.[4] ..... B65D 47/10; B65D 35/08

[52] U.S. Cl. ..... 222/107; 215/250; 215/253; 220/258; 220/266; 222/153; 222/541; 524/427; 524/448

[58] Field of Search ..... 222/92, 107, 541, 153; 220/258, 256, 266; 215/250, 253, 32; 428/241, 237; 524/427, 448, 586

[56] References Cited

U.S. PATENT DOCUMENTS

| | | | |
|---|---|---|---|
| 2,849,739 | 9/1958 | Dresden | 222/92 X |
| 3,156,383 | 11/1964 | Melli . | |
| 3,162,339 | 12/1964 | Lecluyse | 222/541 |
| 3,393,815 | 7/1968 | Turecek . | |
| 3,409,159 | 11/1968 | Velt . | |
| 3,632,004 | 1/1972 | Grimes et al. . | |
| 3,744,654 | 7/1973 | Bromberg . | |
| 3,841,513 | 10/1974 | O'Connor et al. . | |
| 3,894,985 | 7/1975 | Coombs | 524/448 |
| 3,908,654 | 9/1975 | Lhoest et al. | 222/541 |
| 3,950,917 | 4/1976 | Choksi et al. . | |
| 3,993,223 | 11/1976 | Welker, III et al. | 222/541 X |
| 4,022,749 | 5/1977 | Kuechler | 524/586 X |
| 4,056,209 | 11/1977 | Winkler et al. . | |
| 4,104,289 | 8/1978 | Jones | 524/586 X |
| 4,125,514 | 11/1978 | Stabler | 524/586 X |
| 4,157,765 | 6/1979 | Golebiewsky | 222/541 X |
| 4,407,986 | 10/1983 | Nomura et al. | 524/427 X |
| 4,533,602 | 8/1985 | Nakamura et al. | 524/422 X |
| 4,560,712 | 12/1985 | Chiang | 524/427 X |

FOREIGN PATENT DOCUMENTS

| | | | |
|---|---|---|---|
| 731236 | 3/1966 | Canada | 524/427 |
| 1130234 | 10/1968 | United Kingdom . | |
| 1271887 | 4/1972 | United Kingdom . | |
| 1580305 | 12/1980 | United Kingdom . | |

*Primary Examiner*—Frank E. Werner
*Assistant Examiner*—P. McCoy Smith
*Attorney, Agent, or Firm*—Parmelee, Miller, Welsh & Kratz

[57] ABSTRACT

An integral seal member is formed across the outlet in the neck of a tamper evident, thermoplastic container by adding to the thermoplastic material such as polyethylene, 3% to 16%, and preferably about 8% by weight, of an anhydrous solid inorganic particulate additive such as an anhydrous siliceous material or calcium carbonate so that the material becomes brittle enough that the seal member tears cleanly from the neck within the confines of an undercut at the interface between the seal member and neck. Torque is applied to the seal member by providing in the top of a conventional screw cap which forms a resealing closure for the container once opened, a recess with serrations which, when the cap is removed and turned upside down, engage serrations on the peripheral edge of the seal.

21 Claims, 5 Drawing Figures

CONTAINER WITH TWIST-OFF TAMPER EVIDENT FEATURE

BACKGROUND OF THE INVENTION

1. Field of the Invention

This invention is directed to a container with a tamper evident feature and a resealing closure and more particularly to a thermoplastic container with an integral seal in the outlet which, when twisted off by a cooperating means in a replaceable threaded cap, tears cleanly to leave a smooth opening in the container.

2. Prior Art

Recent event have heightened the interest in tamperproof containers for a wide variety of products, most notably those consumed by or used on humans. While it is virtually impossible to thwart a most determined effort to tamper with a packaged product, the general objective is to make it as difficult as possible to do so without detection. It is also important that the container be capable of mass production at an acceptable cost.

A container for industrial chemicals with similar features is disclosed in U.S. Pat. No. 3,156,383. This container is made of plastic and has an opening which is sealed after the container is filled. The outlet is provided in a threaded neck and is closed by an integrally formed, rupturable diaphragm having a pin connected to it which terminates in a flat handle or key. An internally threaded cap has a recess which allows it to be screwed onto the neck without turning the handle. When the container is to be opened, the cap is unscrewed and turned upside down so that a slot in the top of the cap engages the handle and torque may be applied to the handle through the cap to rupture the diaphragm. Since the container can only be opened by tearing the diaphragm, it is immediately evident whether or not the container has been tampered with. The cap may then be used in a conventional manner to reseal the opened container.

In attempting to make containers of polyethylene with a rupturable diaphragm sealing the opening, such as squeezable tubes for dispensing a wide variety of products, it has been found to be difficult to obtain a clean tear. The tendency is for the polyethylene to separate along an unpredictable line leaving an opening with a ragged, rough edge.

It is a primary object of this invention to provide an improved container with an integral sealing member extending across the outlet which must be torn away for access to the contents of the container and therefore provides a visible indication of tampering.

It is another object of the invention to provide such a container made of a thermoplastic material, and preferably polyethylene, in which the sealing member tears cleanly from the outlet.

It is still another object of the invention to provide a container satisfying the previous objects which also has gripping members on a resealing cap which engage gripping members on the sealing member such that the force required to tear the sealing member free from the outlet can be applied with a mechanical advantage provided by the cap.

SUMMARY OF THE INVENTION

These and other objects are realized by a container in which the neck and an integral sealing member extending across an outlet in the neck define a thinner, weaker separation line between them along which the sealing member can be torn from the neck to open the outlet, and in which the neck and sealing member are made of a thermoplastic material containing an anhydrous solid inorganic particulate material having an average particle size of 10 microns or less in a sufficient amount to make the thermoplastic material brittle enough that the tear between the sealing member and neck is confined to the separation line. Such an arrangement provides a tamper evident container in which the sealing member tears cleanly away from the neck to leave a smooth edge on the outlet.

Preferably, the thermoplastic material is polyethylene and the anhydrous solid inorganic particulate material is selected from a group comprising an anhydrous siliceous material and calcium carbonate. The polyethylene contains three to sixteen, and preferably eight, percent by weight of the selected solid particulate material. These preferred solid particulate materials in the stated proportions make the polyethylene brittle enough that it separates cleanly along the separation line which is important to the commercial acceptability of the tamper-evident containers for consumer products. Many of the preferred solid particulate materials do not discolor the polyethylene which is important in some applications.

In the preferred form, the neck of the container is cylindrical and the sealing member is axially aligned with the end of the neck so that the separation line is defined by an annular groove. The neck tapers axially inward toward, and the bottom of the circular seal member extends radially outward from, this annular groove, and a blind bore extends axially into the center of the seal member from the inside beyond the annular groove, such that the stresses applied to the seal member are concentrated at the separation line. The neck is externally threaded so that a cap may be screwed down over the sealing member and may also serve as a resealing closure for the outlet once the sealing member has been removed. The top of the cap defines a gripping member which, when the cap is removed and inverted, engages a cooperating gripping member on the sealing member so that the cap can be used to apply the force to the sealing member necessary to tear it along the separation line. Preferably, the gripping member on the sealing member takes the form of an irregular peripheral edge, such as axially extending serrations, and the gripping member on the cap takes the form of a recess with complementary side walls. With this arrangement, more torque can be applied to the sealing member and it can be flatter than it could be with a recessed or raised gripping member.

Thus, the invention provides a thermoplastic container which is positively sealed until reaching the ultimate user, yet is relatively easy for the consumer to open and unseal, displays a prominent defect if tampered with, and can be resealed if all the contents are not used.

BRIEF DESCRIPTION OF THE DRAWINGS

A full understanding of the invention can be gained from the following description when read in conjunction with accompanying drawings in which.

DESCRIPTION OF THE PREFERRED EMBODIMENTS

Figure 5:
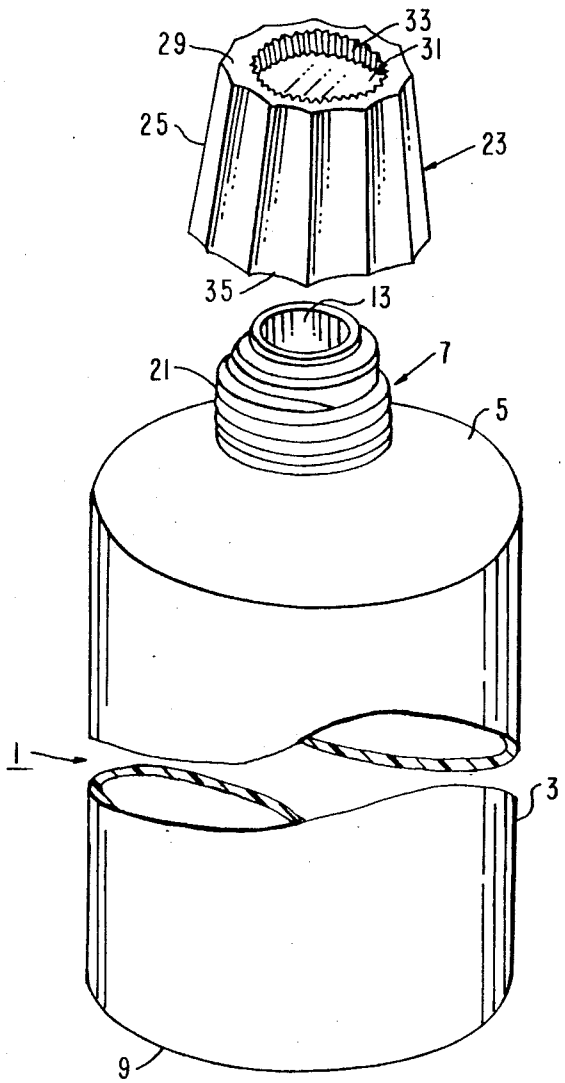
FIG. 5 is an isometric view of the container of FIG. 1 with the sealing member removed and the cap in position for being replaced on the container as a resealing closure.
Figure 3:
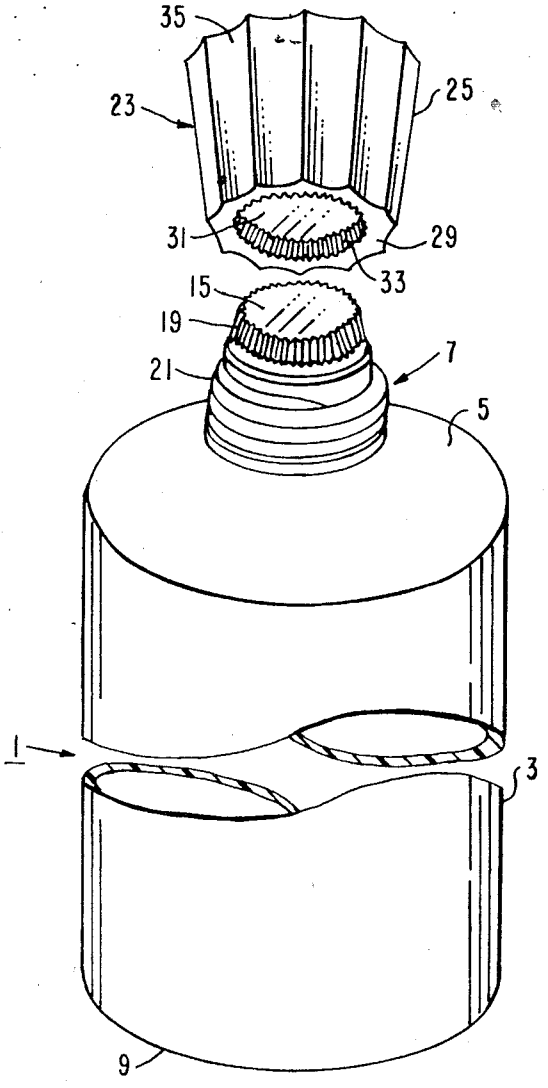
FIG. 3 is an isometric view of the container of FIG. 1 with the replaceable cap removed illustrating how it can be inverted for engagement with a sealing member on the container.
Figure 1:
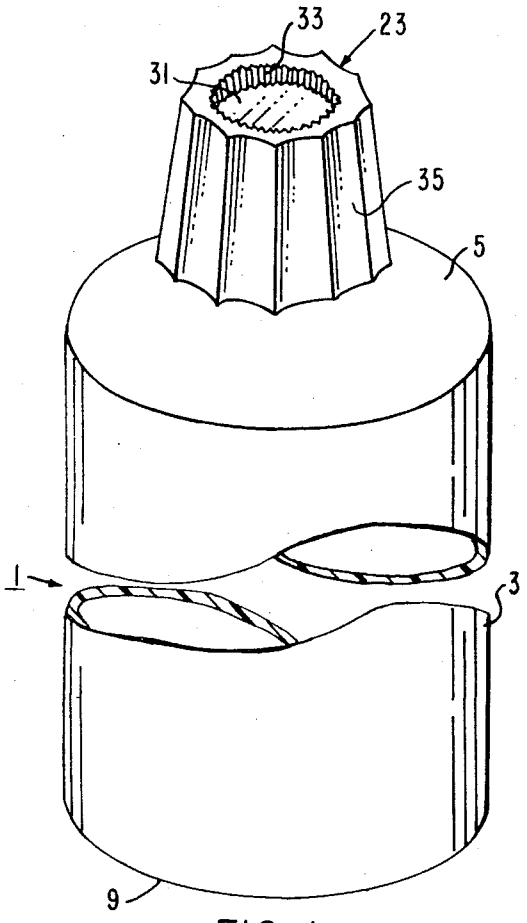
FIG. 1 is an isometric view of a container according to the invention with the replaceable cap in place.
Figure 4:
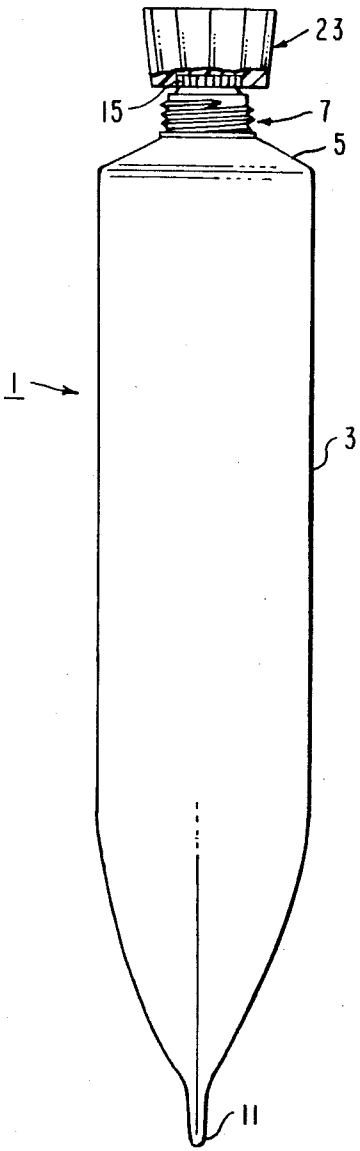
FIG. 4 is a vertical view with parts sectioned illustating the engagement of the recess in the top of the removable cap with the sealing member on a modified form of the container.

As shown in the drawings, a container 1 according to the invention includes a tubular body portion 3 topped by a shoulder portion 5 which terminates in a neck portion 7. The neck and shoulder portions in such containers are typically compression molded onto the body portion using a thermoplastic material. The lower, open end of the tubular, thermoplastic body portion 3 forms a fill opening (not shown). After the container 1 has been filled through the fill opening, the bottom of the container is sealed by molding the thermoplastic material into a flat bottom 9, as shown in the containers of FIGS. 1, 3 and 5, or into a pinched bottom 11, as shown in FIG. 4. Such techniques are conventional and form no part of the present invention other than that they provide a means of making the container of this invention and filling it other than through the container neck.

The neck portion 7 of the container 1 defines an outlet 13. The container is formed with a seal member 15 integrally molded onto the end of the neck 7, and extending completely across and fully closing the outlet 13. The seal member 15 is axially aligned with the neck and where they join is a separation line 17 formed by an external, undercut which makes the material thinner and therefore, weaker along this line. The neck portion 7 tapers up as at 18 to this separation line 17 while the seal member 15 extends radially outward from this point. The seal member 15 is formed with a bore 20 on its inner surface which is a continuation of the bore forming the outlet 13 in the neck portion 7. This configuration provides an easily effected separation of the seal member 15 at the separation line 17, a relatively clean orifice rim and optimum area thickness to allow filling the head at near normal manufacturing pressures. The integral seal member 15 is generally circular with an irregular outer edge. In the preferred form, the outer edge is made irregular by axially extending serrations 19. These serrations 19 taper axially inward in a direction away from the body of the container at about a 5° angle.

The neck 7 is provided with external threads 21 for receiving a cap 23. The cap 23 has a generally cylindrical skirt 25 in which are integrally molded internal threads 27 which engage the threads 21 on the neck 7. The end wall 29 of the cap is provided with an external recess 31 centered on the axis of the cap. The side wall of this recess 31 is provided with serrations 33 which match the serrations 19 on the seal member 15 and are similarly tapered at about 5° to facilitate their engagement. The outer surface of skirt portion 25 of the cap 23 may be provided with scalloped, axially extending indentations 35 or other conventional surface treatment to provide a gripping surface for rotating the cap 23.

Figure 2:
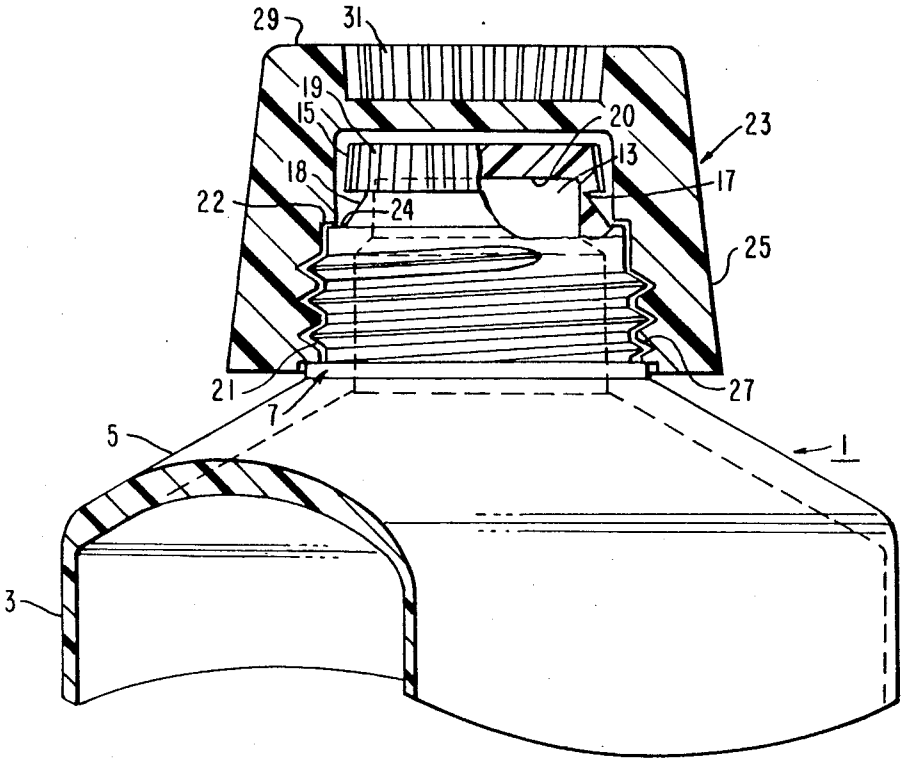
FIG. 2 is a vertical view in enlarged scale, with some parts sectioned, of the upper portion of the container of FIG. 1.

With the container filled and the bottom sealed, the contents are inaccessible without permanent, evident alteration to the container. In use, the cap 23 is unthreaded from the neck, turned over as illustrated in FIG. 3, and placed inverted on the top of the container with the serrations 33 engaging those 19 on the seal member 15, as shown in FIG. 4. Rotation of the cap 23 applies torque to the seal member 15 which tears it from the neck portion 7 along the separation line 17 thus opening the outlet 13. The contents of the container 1 can then be selectively dispensed through the outlet 13. Once the seal member 15 has been torn loose, it cannot, without extraordinary effort, be returned to its initial condition, thus providing a permanent indication that the container 1 has been opened. The cap 23 can then be turned back over to the position shown in FIG. 2 and threaded onto the neck of the container to form a conventional replaceable closure for the outlet 13. As is conventional with this type of closure, a shoulder 22 on the cap seats on a shoulder 24 on the neck portion 7 to form the reusable seal.

Presently available thermoplastic containers with tear away seals typically leave a ragged, rough edge to the opening formed by removal of the seal. By adding solid particles to the thermoplastic, it has been found that the thermoplastic material is made brittle enough that it breaks cleanly along a separation line formed by an undercut such as at 17 in the container described above. Many of the presently used thermoplastic squeezable containers are made of polyethylene. The anhydrous solid inorganic particulate materials tested included anhydrous siliceous materials and calcium carbonate.

By way of example, the addition of about 8% by weight of calcium carbonate having an average particle size of less than 10 microns to low density polyethylene was used to compression mold the shoulder, neck and integral seal on the container 1 detailed above where the thickness of the polyethylene with the calcium carbonate additive at the separation line 17 was 7 to 17 thousands of an inch. This produced a smooth edge which was confined to the separation line when the seal member was torn away as described. Experiments have shown that beginning at an addition of about 3% by weight of the calcium carbonate, the additive becomes effective to provide the desired smooth opening. Improved results were achieved as additional calcium carbonate was added but at a reduced rate of increase in results such that the ideal mixture was found to be about 8% by weight of calcium carbonate. Additions of calcium carbonate in amounts above 16% by weight did not appear to be economically justified. It was found that the calcium carbonate discolored the polyethylene, however, such discoloring can be masked by the use of darker pigments in the polyethylene.

In another example, an antiblock material identified as Polyethylene Antiblock Masterbatch Code 10126 by its manufacturer, Ampacet Corporation, of Mount Vernon, N.Y. was used to supply the additive. The product contains about 20% solid particulate material, believed to be a diatomaceous silica, mixed in a low density polyethylene base which is normally used to make polyethylene films in which the wraps of the film on a roll do not stick together because the particles are thick enough to prevent complete surface contact between adjacent wraps. This material was added to the polyethylene used to compression mold the container heads in varying amounts. Again, it was found that a resultant mixture with 3% to 16% of the solid particulate material by weight produced the desired results of a relatively clean break within the confines of the separation line 17 with the ideal amount being about 8%.

Another product tested as the particulate material was anhydrous nepheline syenite sold under the trademark MINEX by Indusmin Limited of Toronto, Canada. It is a naturally occurring igneous feldspathic rock which can be chemically identified as sodium potassium aluminum silicate with a chemical formula of:

$$3Na_2O.K_2O.4.5Al_2O_3.2O\ SiO_2$$

Again, the desired results were achieved with about 3% to 16% by weight of MINEX with a preferred amount of about 8%. This product was preferred over all the others because it deomonstrated good flow characteristics, the best transparency of the products tested, no discoloration, good torque break off, and a clean break.

Additional materials tested included: a diatomaceous earth or silica, or diatomite, sold under the trademark DICALITE by the manufacturer, Grefco, Inc. of Torrance, Calif. which consists predominantely of silicon dioxide; a microcrystalline silicon dioxide sold under the trademark IMSIL by the manufacturer, Illinois Minerals Co. of Cario, Ill. which is over 99.5% silicon dioxide; and microcrystalline soft silica identified as 1A Rouge by its manufacturer, Tammsco, Inc. of Tamms, Ill. which is also over 99.5% silicon dioxide. As with the other materials, 3% to 16% and preferably about 8% by weight of the particulate material provided the desired results. The Dicalite comprised soft silica short polymer chain crystals which results in a more elastic structure and was not as transparent as the MINEX. The INSIL worked well and the 1A Rouge flowed well, and had good torque break-off, but it discolored. All of the siliceous materials used had an average particle size of 10 microns or less.

The addition of a filler weakens the polymer matrix with inert particles and reduces the surface tension. The reduced surface tension and weakened film provide the proper tear properties for the twist-off to be functionally acceptable for large orifices. The orifices in the above examples were about 0.320 inches in diameter.

While the serrations 19 and 33 respectively on seal member 15 in the recess 31 in the cap 23 provide a very effective connection between the seal member and cap, this coupling could be effected by various other shapes and configurations. In fact, it is not necessary to the broad aspects of the invention that they even be coupled. If a sufficient grip can be gained on the seal member, such as through a key member molded onto the top of the seal, the seal could be torn loose from the container without using the cap to obtain leverage.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

We claim:

1. A tamper evident container comprising a hollow body portion, a neck portion at one end of the hollow body portion defining the only outlet for the hollow body portion, and a sealing member formed integrally with the neck portion and extending completely across said outlet to seal the container, but with adjacent portions of said sealing member and neck portion defining a separation line at their interface which is thinner and structurally weaker than both said neck portion and sealing member, said sealing member also defining gripping means by which a force may be applied to said sealing member to tear the sealing member from the neck portion along said separation line, said adjacent portions of the sealing member and neck portion being integrally formed of a thermoplastic material containing an anhydrous solid particulate inorganic material with an average particle size of 10 microns or less in an amount of about three to sixteen percent by weight to make the thermoplastic material brittle enough that said tear is confined to said separation line.

2. The container of claim 1 wherein said thermoplastic material is polyethylene.

3. The container of claim 2 wherein the polyethylene contains a solid particulate material selected from a group consisting of an anhydrous siliceous material and calcium carbonate.

4. The container of claim 3 wherein the solid particulate material is an anhydrous siliceous material.

5. The container of claim 4 wherein the polyethylene contains about eight percent by weight of said anhydrous siliceous material.

6. The container of claim 3 wherein said solid particulate material is calcium carbonate.

7. The container of claim 6 wherein the polyethylene contains about eight percent by weight of said calcium carbonate.

8. The container of claim 3 including a cap and in which said cap and said neck portion define cooperating locking means by which said cap may be removably secured to the neck portion to cover said sealing member and to provide a selective seal for said outlet once said sealing member has been torn from the neck portion.

9. The container of claim 8 in which said cap has a top portion defining gripping means which, when the cap is removed from the neck portion and inverted, engages the gripping means defined by said seal member whereby the force required to tear the seal from the neck portion can be applied through said cap.

10. The container of claim 1 wherein said neck portion terminates in a cylindrical section which defines said outlet and said sealing member comprises a generally planar member across the end of the cylindrical section of the neck member to define therewith a cicular separation line.

11. The container of claim 10 wherein said planar member is generally cylindrical, larger in diameter than the outlet defined by the cylindrical section of said neck member and is axially aligned with the cylindrical section of the neck.

12. The container of claim 10 wherein said planar member, though generally circular, has an irregular peripheral edge which constitutes said gripping means.

13. The container of claim 12 wherein said neck portion is provided with external threads and including a cap provided with internal threads which may be threaded onto said neck portion to provide a removable closure for the container, said cap having an end portion with a recess in the outer surface thereof which when the cap is unthreaded from the neck portion and turned over, engages the irregular peripheral edge of the planar member such that torque may be applied to the sealing member through the engaged cap to effect tearing of the sealing member from the neck portion.

14. The container of claim 11 wherein the end of said neck portion tapers axially inward toward said axially aligned generally circular sealing member to form said separation line, said sealing member extending generally radially outward from said separation line.

15. The container of claim 14 wherein said generally circular sealing member defines a blind bore which is axially aligned with and forms a continuation of the outlet defined by the cylindrical neck and which extends axially into the sealing member beyond the circular separation line.

16. A tamper evident container comprising a hollow body portion, a neck portion at one end of the hollow body portion defining the only outlet for the hollow body portion, and a sealing member formed integrally with the neck portion and extending completely across said outlet to seal the container, but with said sealing member and neck portion defining a separation line at their interface which is thinner and structurally weaker than both said neck portion and sealing member, said sealing member also defining gripping means by which a force may be applied to said sealing member to tear the sealing member from the neck portion along said separation line, said sealing member and neck portion being integrally formed of polyethylene containing about three to sixteen percent by weight of an anhydrous siliceous material to make the thermoplastic material brittle enough that said tear is confined to said separation line.

17. The container of claim 16 wherein said polyethylene contains about eight percent by weight of said anhydrous siliceous material.

18. The container of claim 16 wherein said neck portion is cylindrical to define a circular outlet and is provided with integral external threads, wherein said sealing member comprises a generally circular, planar member larger in diameter than the circular outlet and axially aligned with said cylindrical neck portion, said planar member having axially extending serrations in the peripheral edge thereof, said container including a cap provided with internal threads which may be threaded onto the threads of the neck portion to provide a removable closure for the container, said cap having an end portion defining a recess in the outer surface thereof with serrated walls which when the cap is unthreaded from the neck portion then turned over, engage the serrated edge of the planar member such that torque may be applied to the sealing member through the engaged cap to effect tearing of the sealing member from the neck portion.

19. A tamper evident container comprising a hollow body portion, a neck portion on one end of the hollow body portion defining a bore which forms the only outlet for the container, the end of said neck portion tapering axially inward toward said bore, and a generally disc-shaped sealing member integrally formed on the end of the neck portion and extending completely across said bore to seal the outlet, the tapered end of the neck portion and the generally disc-shaped sealing member, which is larger in diameter than said tapered end of the neck portion, forming at their intersection a separation line which is thinner and structurally weaker than both the neck portion and the sealing member, said neck portion and sealing member integrally formed from a thermoplastic containing about three to sixteen percent by weight of a solid particulate anhydrous siliceous material, to make the thermoplastic material brittle enough that a tear is confined to said separation line, said sealing member defining a blind bore which is axially aligned with and forms a continuation into said seal member of said bore in the neck portion, said blind bore extending axially into the seal member beyond said separation line, and said seal member also defining gripping means by which said seal member may be gripped and twisted to apply a torque which tears the seal member from the neck portion along said separation line.

20. The tamper evident container of claim 19 wherein the peripheral edge of the generally disc-shaped sealing member is irregular and forms said gripping means.

21. The tamper evident container of claim 20 wherein said thermoplastic is polyethylene.

* * * * *